US005379894A

United States Patent [19]

Haas et al.

[11] Patent Number: 5,379,894

[45] Date of Patent: Jan. 10, 1995

[54] PAPERBOARD PACKAGE

[75] Inventors: Janice Haas, Bethlehem, Conn.; Patrick J. O'Brien, Hackensack, N.J.; Larry D. Durham, Terre Haute, Ind.

[73] Assignee: Ivy Hill Corporation, New York, N.Y.

[21] Appl. No.: 37,603

[22] Filed: Mar. 25, 1993

[51] Int. Cl.[6] ..... B65D 73/00

[52] U.S. Cl. ..... 206/333; 206/45.14; 206/461

[58] Field of Search ..... 206/45.14, 333, 461, 206/462, 469; 229/109, 110

[56] References Cited

U.S. PATENT DOCUMENTS

| | | | |
|---|---|---|---|
| 1,711,877 | 5/1929 | Drehmann . | |
| 1,787,736 | 1/1931 | Schrier . | |
| 2,081,656 | 5/1937 | Anthony | 206/333 |
| 2,465,661 | 3/1949 | Ringler . | |
| 2,644,633 | 7/1953 | Stopper . | |
| 2,828,008 | 3/1958 | Fryburger . | |
| 2,984,401 | 5/1961 | Herkender . | |
| 3,184,046 | 5/1965 | Berg | 206/45.14 |
| 3,487,915 | 1/1970 | Scott . | |
| 3,815,735 | 6/1974 | Cucuo . | |
| 3,918,583 | 11/1975 | Adams | 206/45.14 |
| 3,985,232 | 10/1976 | Johnson . | |
| 3,990,578 | 11/1976 | Roeser . | |
| 4,127,228 | 11/1978 | Hall . | |
| 4,200,188 | 4/1980 | Webinger . | |
| 4,209,005 | 6/1980 | Dutcher | 206/469 |
| 4,279,376 | 7/1981 | Roccaforte | 206/45.14 |
| 4,354,598 | 10/1982 | Schillinger . | |
| 4,570,787 | 2/1986 | Forbes, Jr. . | |
| 4,696,402 | 9/1987 | Harmon et al. | 206/333 |
| 4,773,622 | 9/1988 | Herlin | 229/110 |
| 4,848,568 | 7/1989 | Eckelman | 206/333 |
| 4,896,770 | 1/1990 | Calcerano et al. . | |
| 4,958,731 | 9/1990 | Calcerano | 206/333 |

FOREIGN PATENT DOCUMENTS

| | | | |
|---|---|---|---|
| 531654 | 3/1993 | European Pat. Off. | 206/333 |
| 1147171 | 11/1960 | Germany | 206/333 |

*Primary Examiner*—David T. Fidei

*Attorney, Agent, or Firm*—Amster, Rothstein & Ebenstein

[57] ABSTRACT

An ecologically-acceptable and easy-to-open package formed exclusively of paperboard for the display and sale of a plurality of cylindrical articles (such as batteries) as a unit. The package includes a base for maintaining a plurality of cylindrical articles upright and parallel in a compact, horizontally-aligned configuration. The base includes a base top, a base bottom, and a base sidewall connecting the base top and the base bottom. A header extends upwardly from the base top. Where there are two such articles in the package, the base sidewall is trapezoidal; where there are four, hexagonal.

26 Claims, 10 Drawing Sheets

FIG. 2
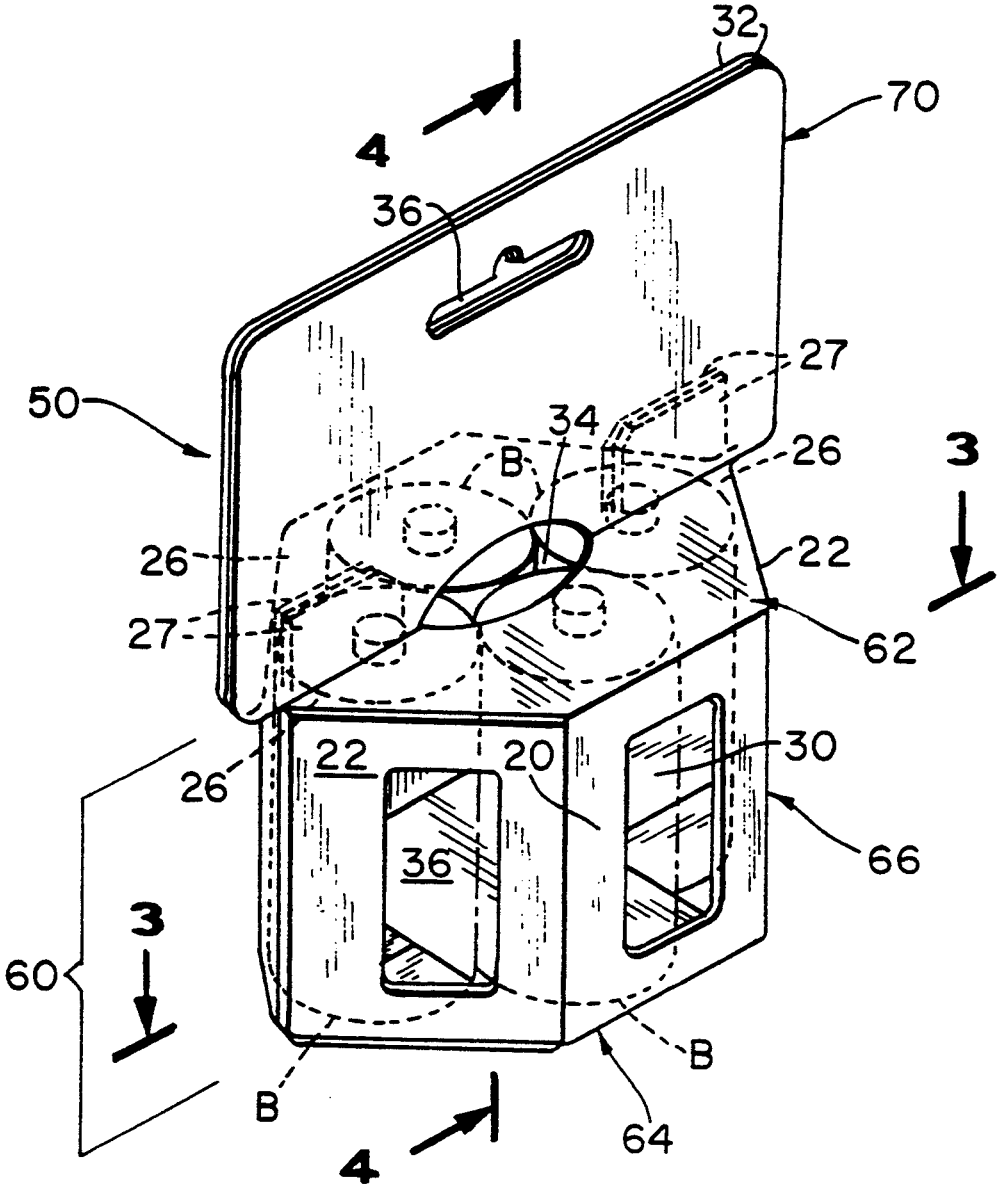
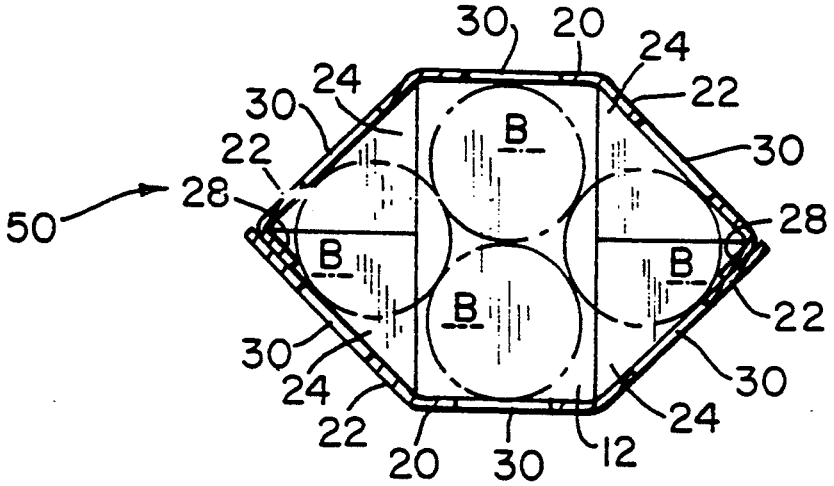
FIG. 3

FIG. 7
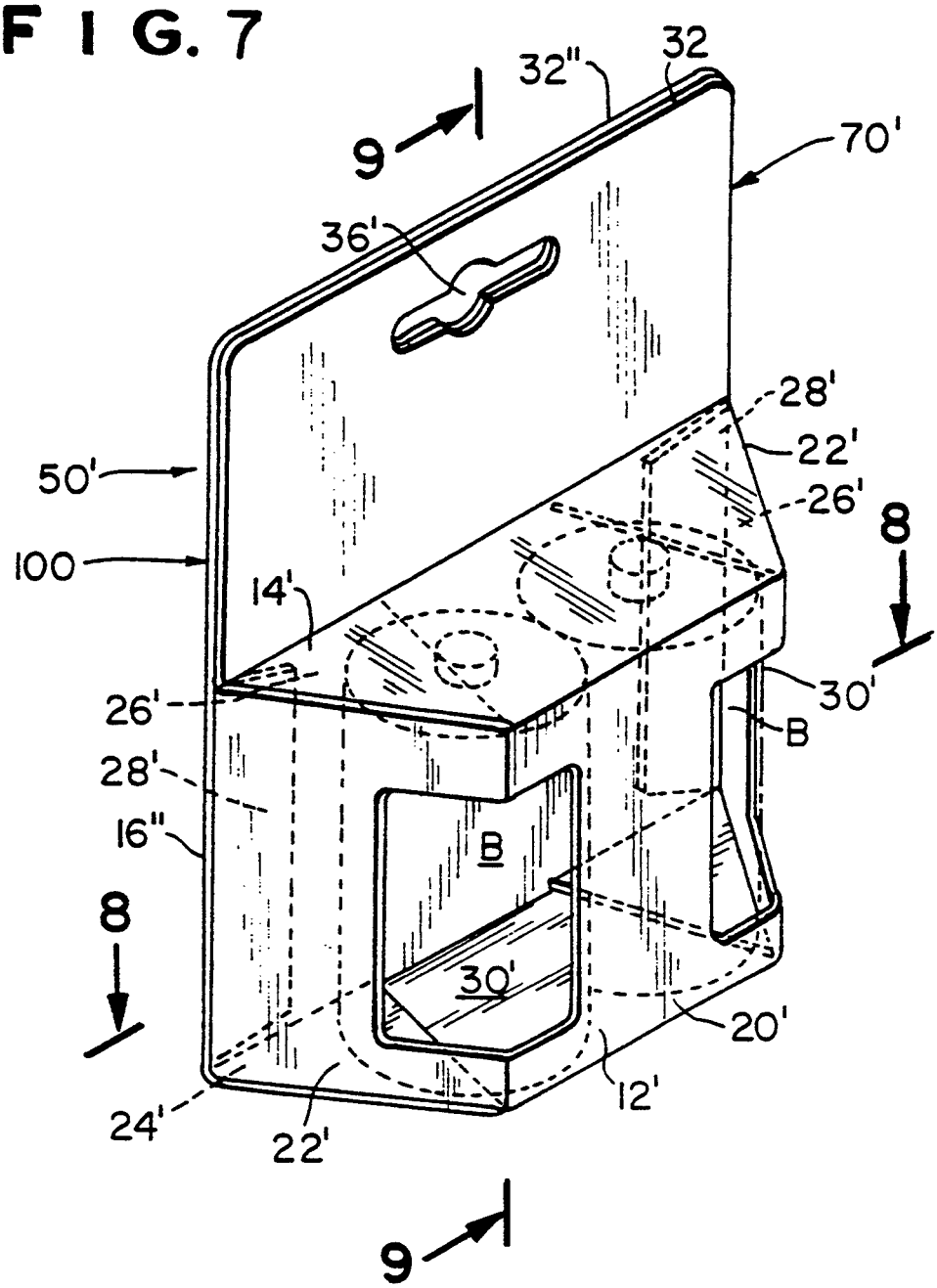
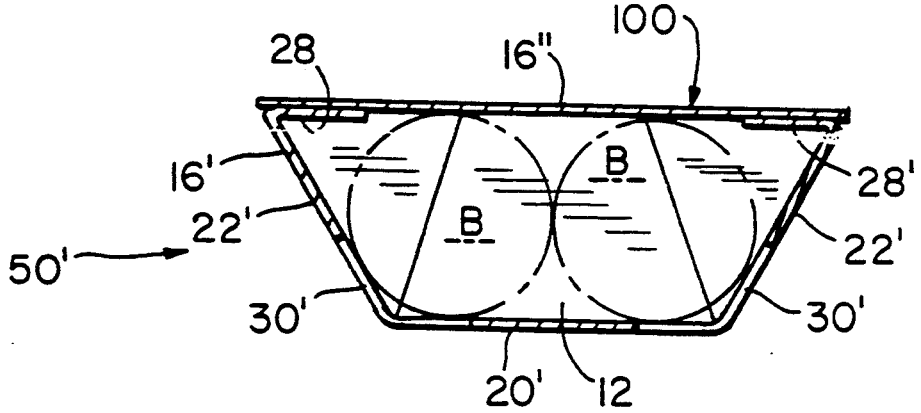
FIG. 8

PAPERBOARD PACKAGE

BACKGROUND OF THE INVENTION

The present invention relates to a package for the display and sale of a plurality of cylindrical articles as a unit, and more particularly to such a package which is both ecologically-acceptable and easy-to-open.

Batteries and like dense cylindrical articles of comparable size are frequently packaged together as a unit for display and sale, each package typically including two or four batteries. From the point of view of the manufacturer, the conventional plastic blisterboard package is ideal for this purpose since it is inexpensive, easy to manufacture, and of sufficient strength to hold even four "D" batteries. Further, the transparent blisterboard package enables the manufacturer to satisfy the desire of the consumer to verify that the intended number of batteries are present in each package and that the batteries are in good condition. Finally, the blisterboard package enables the batteries to be disposed in a relatively compact configuration, extending in some instances to both sides of the header, so that the package conserves the limited available linear display space in a retail establishment.

On the other hand, the plastic blisterboard package is not entirely satisfactory from the point of view of the consumer or the environment. Most consumers find it very difficult to open the blisterboard package even when the paperboard portion of the package has been suitably scored to facilitate battery removal. The environmentalist finds the plastic blisterboard package unacceptable because of its use of plastic, a non-biodegradable material. To date, however, the concern of the manufacturer has prevailed since it is simply unacceptable that a battery package will fall apart either during shipment or while suspended by a header from a support.

Accordingly, it is an object of the present invention to provide a package for the display and sale of a plurality of cylindrical articles as a unit.

Another object is to provide such a package which is both ecologically-acceptable and easy-to-open.

A further object is to provide such a package which enables the prospective purchaser to confirm that the intended number of articles are present in the package and in good condition.

It is also an object of the present invention to provide an embodiment of such a package wherein the articles are maintained in a compact configuration.

It is another object to provide a blank from which such a package can be formed.

SUMMARY OF THE INVENTION

It has now been found that the above and related objects of the present invention are obtained in an ecologically-acceptable and easy-to-open package formed exclusively of paperboard for the display and sale of a plurality of cylindrical articles as a unit. The package comprises a base means for maintaining a plurality of cylindrical articles upright and parallel in a compact, horizontally-aligned configuration, the base means including a base top, a base bottom, and a base sidewall connecting the base top and the base bottom. A header means extends upwardly from the base top.

The package is formed from a single paperboard blank, with the header means formed of two upwardly extending header panels glued together. The header means defines an aperture for hanging of the package from a support. In the absence of tearing of the base means, the cylindrical articles within the base means are not removable therefrom without separation of the two header panels of the header means or while the header means is suspended by the aperture from a support.

In a first preferred embodiment of the package, the base means is configured and dimensioned to maintain four of the cylindrical articles upright and parallel in a compact, non-linear, horizontally-aligned configuration.

The base sidewall is generally hexagonal and defined by a pair of base half-sidewalls disposed in an opposed relationship. The base sidewall is further defined by a pair of side seal flaps, each side seal flap extending from a given base half-sidewall and overlapping and being secured to another base half-sidewall. A center portion of each base half-sidewall extends from the base bottom at the bottom and from the base top at the top. The side portions of each base half-sidewall are non-parallel to the center portion thereof and define top and bottom dust flaps overlapping, adhered to and reinforcing the base top and the base bottom, respectively. The top dust flaps preferably define extension tabs overlapping, disposed in and adhered to the header means.

The base sidewall defines a plurality of apertures therethrough for viewing of each of the cylindrical articles, and the base top defines a central aperture therethrough through which each of the cylindrical articles may be viewed.

The present invention also encompasses in a first embodiment a unitary, integral, one-piece paperboard blank for an all-paperboard display and sale package. The blank comprises a bottom panel, a pair of top half-panels cooperatively defining a top panel in the erected package, and a pair of side half-panels cooperatively defining a side panel in the erected package. The center portion of each side half-panel joins a respective opposed side of a center portion of the bottom panel and a center portion of a respective top half-panel. The end portions of each side half-panel define at the bottom thereof bottom dust flaps configured and dimensioned to overlap the bottom panel in the erected package and at the top thereof top dust flaps configured and dimensioned to overlap the top panel in the erected package. A pair of header panels extend from respective top half-panels, the header panels being secured together in the erected package to define a head. The header in the erected package causes the pair of top half-panels to cooperatively define the top panel and the pair of side half-panels to cooperatively define the side panel. The top dust flaps further define extension tabs configured and dimensioned to overlap, be disposed in and adhered to the header in the erected package.

In the erected package, the bottom dust flaps overlap side portions of the bottom panel and the top dust flaps overlap side portions of the top half-panels. The side half-panels together define a pair of side seal flaps adapted to extend from a given side half-panel and be secured to another side half-panel in the erected package. The top half-panels are generally trapezoidal, the side half-panels are generally rectangular, and the bottom panel is generally hexagonal; and in the erected package, the top, side and bottom panels are each generally hexagonal in plan. The bottom panel defines a straight foldline extending from one side thereof to the other.

In a second preferred embodiment of the package, the base means is configured and dimensioned to maintain two of the cylindrical articles upright and parallel in a compact, linear, horizontally-aligned configuration.

The base sidewall is generally trapezoidal and defined by a planar base half-sidewall and a non-planar base half-sidewall disposed in opposed relationship. The base sidewall is further defined by a pair of non-engaging side seal flaps, each side seal flap extending from a given base half-sidewall (typically the non-planar one) and overlapping and being secured to the other base half-sidewall (typically the planar one). A center portion of the non-planar base half-sidewall extends from the base bottom at the bottom and from the base top at the top, the side portions of the non-planar base half-sidewall being non-parallel to the center portion thereof. The side portions of the non-planar base half-sidewall define top and bottom dust flaps overlapping, adhered to and reinforcing the base top and the base bottom, respectively, the non-planar base half-sidewall defining a plurality of apertures therethrough for viewing of each of the cylindrical articles.

The header means is formed of two flaps secured together, one of the header flaps being integral with the base top and the other of the header flaps being integral with the planar base half-sidewall. The header means defines an aperture for hanging of the package from a support.

The present invention further encompasses in a second embodiment a unitary, integral, one-piece paperboard blank for an all-paperboard display and sale package. The blank comprises a bottom panel, a top panel, and a pair of side half-panels cooperatively defining a side panel in the erected package. The center portion of one side half-panel joins a respective opposed side of a center portion of the bottom panel and a center portion of the top panel, the end portions of the one side half-panel defining at the bottom thereof bottom dust flaps configured and dimensioned to overlap the bottom panel in the erected package and at the top thereof top dust flaps configured and dimensioned to overlap the top panel in the erected package. A pair of header panels extending from the top panels and the one side half-panel, respectively, and are secured together in the erected package to define a header, the header in the erected package causing the pair of side half-panels to cooperatively define the side panel.

In the erected package the bottom dust flaps overlap, are adhered to and reinforce side portions of the bottom panel and the top dust flaps overlap, are adhered to and reinforce side portions of the top panel. The side half-panels together define a pair of side seal flaps adapted to extend from a given side half-panel and be secured to another side half-panel in the erected package. The one side half-panel defines a plurality of apertures which in the erected package enable viewing of the contents thereof. In the erected package, the top, side and bottom panels are each generally trapezoidal in plan.

In a variation of the package according to the first embodiment, one of the base half-sidewalls defines a plurality of apertures therethrough for viewing of each of the cylindrical articles adjacent such one base half-sidewall, but the other of the base half-sidewalls is unapertured. One of the base half-sidewalls, in cooperation with the base top, has a line of weakness defining an openable door, which door, when opened, enables successive passage therethrough of the cylindrical articles without any tearing of the package.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 2 is an isometric view of an erected package according to a first embodiment of the present invention;

FIGS. 3 and 4 are sectional views thereof taken along the lines 3—3 and 4—4 of FIG. 2, with FIG. 4 showing the package being suspended from a support extending through the header;

FIG. 7 is an isometric view of an erected package according to a second embodiment of the present invention;

FIGS. 8 and 9 are sectional views thereof taken along the lines 8—8 and 9—9 of FIG. 7, with FIG. 9 showing the package being suspended from a support extending through the header;

DETAILED DESCRIPTION OF THE PREFERRED EMBODIMENTS

Figure 1:
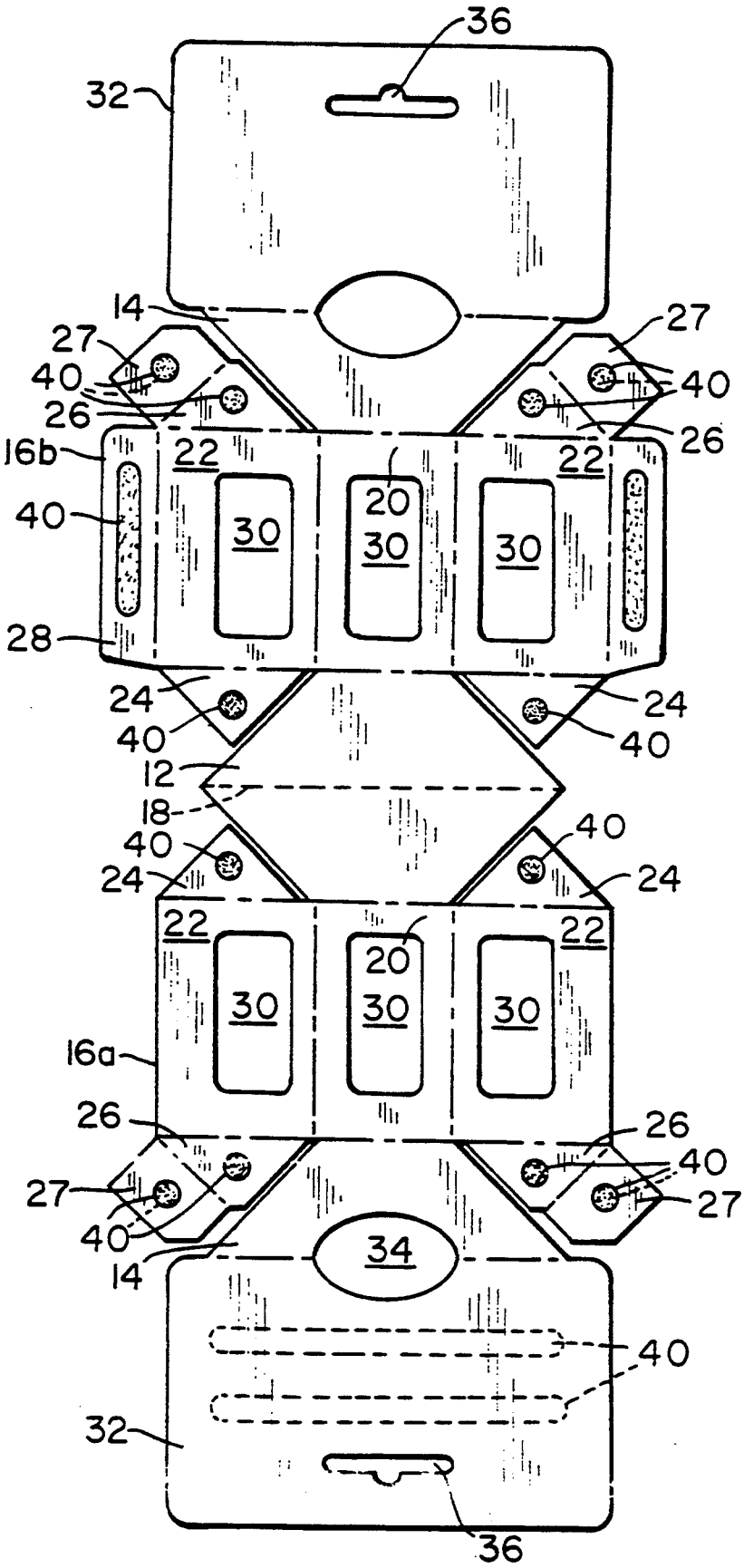
FIG. 1 is a top plan view of a blank according to a first embodiment of the present invention.

Referring now to the drawing, and in particular to FIG. 1 thereof, therein illustrated is a unitary, integral, one-piece paperboard blank according to the present invention, generally designated by the reference numeral 10. The blank 10 comprises a bottom panel 12, a pair of top half-panels 14 (which cooperatively define a top 62 in the erected package of FIGS. 2–4) and a pair of side half-panels 16 (which cooperatively define a sidewall 66 in the erected package of FIGS. 2–4).

The bottom panel 12 is generally hexagonal with a straight foldline 18 extending from one side thereof to the other. The purpose of the foldline 18 is to permit a novel and highly efficient manner of erecting and filling the erected package formed from the blank, as will be described hereinafter.

Each of the top half-panels 14 is generally trapezoidal, although the top panel 62 (see FIGS. 2–4) formed thereby in the erected package is generally hexagonal in plan.

Figure 4:
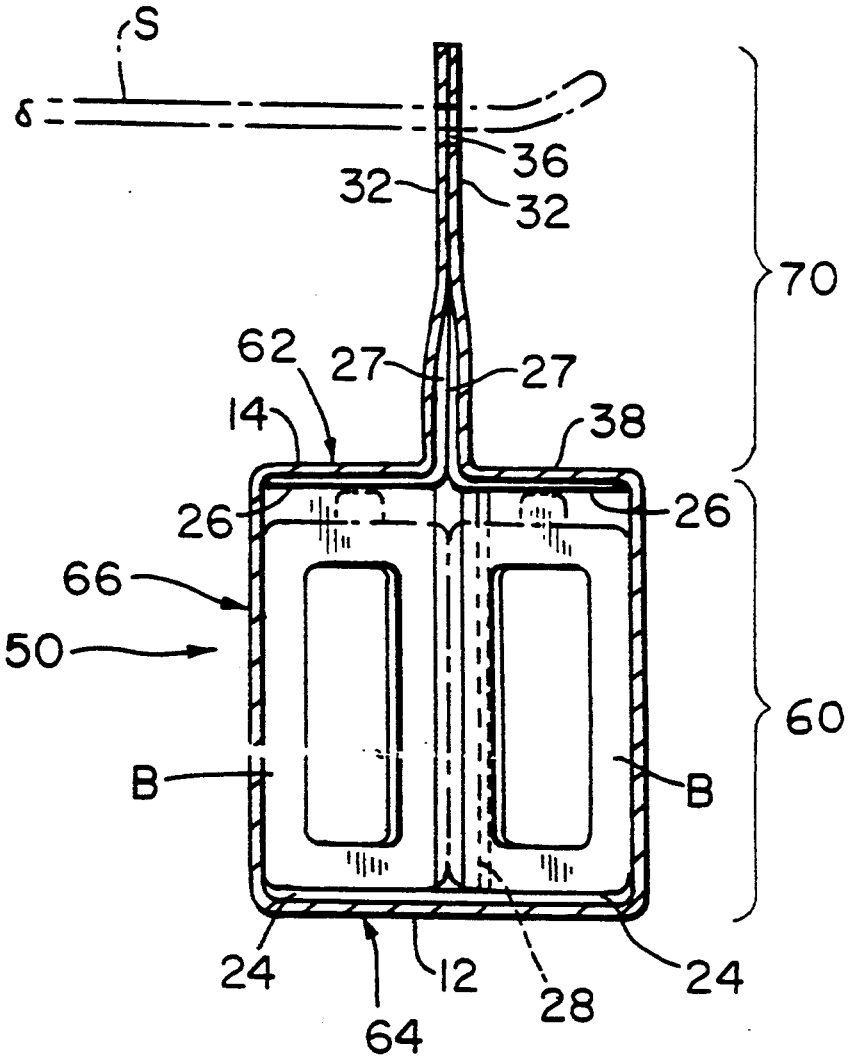

Each side half-panel 16*a*, 16*b* has a center portion 20 connected to a respective opposed side of a center portion of the bottom panel 12 by a foldline and to a center portion of a respective top half-panel 14 by a foldline. The end portions 22 of each side half-panel 16 (one to each side of the center portion 20) define at the bottom thereof foldable triangular bottom dust flaps 24 configured and dimensioned to overlap the bottom panel 12 in the erected package, and at the top thereof foldable triangular top dust flaps 26 configured and dimensioned to overlap the top 62 (formed from the top half-panels 14) in the erected package. In the erected package, as best seen in FIG. 4, the bottom dust flaps 24 overlap and are above end portions of the bottom panel 12, and the top dust flaps overlap and are under end portions of the top half-panels 14.

The side half-panels 16 are generally rectangular in the blank 10, but are folded in the erected package so that the sidewall 66 formed therefrom in the erected package is generally hexagonal in plan. Each side half-panel 16 defines a plurality of apertures 30 (here illustrated as three) which enable viewing therethrough of the contents of the erected package. The side half-panels 16*a*, 16*b* together define a pair of foldable side seal flaps 28 adapted to extend in the erected package from one of the side half-panels and be secured to the other side half-panel. As illustrated, both side seal flaps 28 are disposed on opposite sides of the side half-panel 16*b*, but clearly they could also be disposed on opposite sides of the other side half-panel 16*a*, or one side seal flap could be disposed on each of the side half-panels 16.

Each header panel 32 is generally rectangular in configuration (although other configurations may be used equally as well) and connected to a respective side half-panel 16 by a respective top half-panel 14. More particularly, the short side of the trapezoidal top half-panel 14 is connected to the side half-panel 16 by a foldline, and the long opposed side of the trapezoidal top half-panel 14 is secured to the header panel 32 by a foldline. Each top half-panel 14 and its adjacent header panel 32 cooperate to define an oval aperture 34. While the side panel apertures 30 permit a view of the contents of the erected package from one angle, the apertures 34 permit a view of the contents from a different angle. The header panels 32 additionally define a slot 36 to facilitate suspension of the erected package from a support S, as indicated in FIG. 4. A pair of header panels 32 are secured in face-to-face relationship to define a header 70 in the erected package of FIGS. 2–4.

In order to provide added strength to the structure so that it can withstand the relatively heavy weight of, for example, four "D" batteries, without losing its intended configuration, each top dust flap 26 preferably additionally defines an extension tab 27 of generally rectangular configuration. The extension tab 27 is disposed on a side of the triangular top dust flap 26 which is neither connected to a side half-panel portion 22 nor adjacent a top half-panel 14. The extension tabs 27 are configured and dimensioned to overlap, to be disposed between and adhered to the header panels 32 in the erected package.

When the blank 10 is ready to be erected, a variety of glue areas 40 are disposed on one side of the side seal flaps 28, the top and bottom dust flaps 26, 24, and one or both of the header panels 32, and preferably on both sides of the extension tabs 27. (Alternatively, the glue areas 40 may be disposed on the surfaces contacted by these components or added to the blank 10 during the erection process.) Thus, referring now to FIGS. 2–4 as well, in the erected package the two side half-panels 16*a*, 16*b* are secured together by the side seal flaps 28 to form sidewall 66, the bottom dust flaps 24 are secured to the bottom panel 12 to form bottom 64, the top dust flaps 26 are secured to the two top half-panels 14 to form top 62, and the header panels 32 are secured to one another, with the extension tabs 27 therebetween, to form header 70. (It will be appreciated that the glue areas 40 on the header panels 32 and some of the glue areas 40 on the extension tabs 27 are disposed underneath the surfaces illustrated in FIG. 1, as the blank is intended to be folded into the sheet of drawing in FIG. 1.)

The erected carton 50 illustrated in FIGS. 2–4 is easily formed from the blank 10. The two halves of the package 50—that is, the package half to one side of foldline 18 and the package half to the other side of foldline 18—are preferably formed simultaneously, with the two halves of the bottom panel 12 (on opposite sides of foldline 18) folded into a face-to-face relationship but not glued to one another. The package is then easily formed about a mandrel (not shown) inserted downwardly into each half of the package 50.

Figure 5:
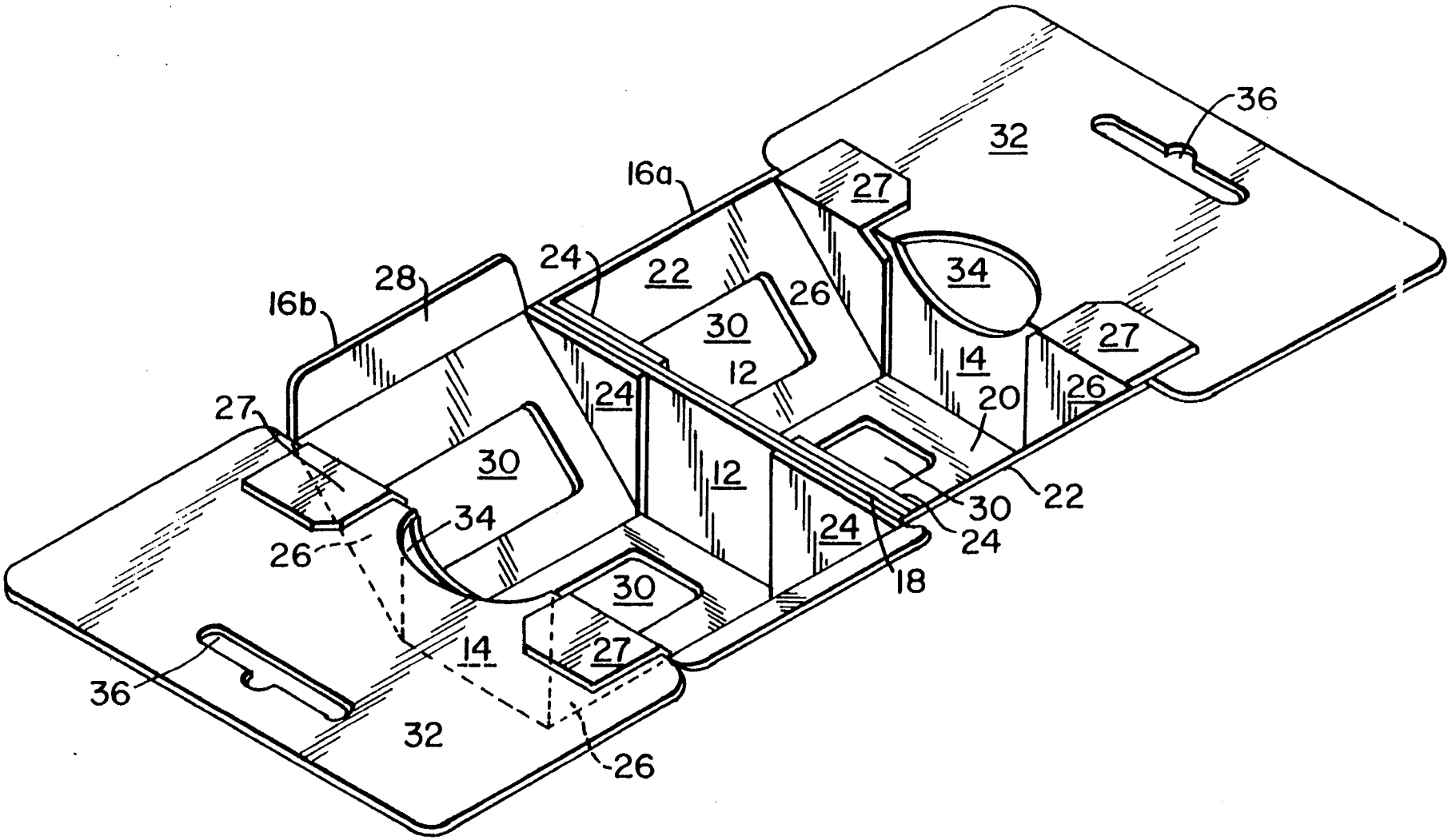
FIG. 5 is a fragmentary isometric view of the package in an intermediate stage of erection.

Referring now to FIG. 5, the top half-panel 14 is folded upwardly (parallel to the halves of the bottom panel 12). The side half-panel 16*b* has the outer portions 22 folded upwardly about the mandrel, relative to the center portion 20, so as to define a three-sided concavity or cup-like structure. The bottom dust flaps 24 are folded inwardly and then the bottoms thereof are glued to the bottom panel 12, while the upper dust flaps 26 are folded inwardly (parallel to the bottom dust flaps 24) and then the tops thereof are glued to the top half-panel 14. The header panel is bent perpendicular to the top half-panel 14, and then the extension flaps 27 are bent parallel to the header panel 32 and glued thereto. The other side of the package (incorporating side half-panel 16*a*) is formed in the same manner, preferably simultaneously.

Once each half of the package (on an opposite side of the vertical plane through the foldline 18 of base panel 12) has been formed into a concavity, the mandrel is removed therefrom and the cylindrical articles, such as batteries B, are dropped into one of the concavities. The batteries B will compactly arrange themselves within the concavity under the influence of gravity. The concavity is then easily sealed by bringing the other concavity thereover, thereby returning the bottom panel 12 to planarity. Thus, after one concavity is loaded with batteries B, as the two final steps, the side seal flaps 28 are glued to the end or outer portions 22 of the opposite side half-panel 16 to form a base 60 (see FIGS. 2–4), and the two header panels 32 are glued together face-to-face, with all four extension tabs 27 therebetween, to form header 70 and to lock the top half-panels 14 in a fixed relationship defining top 62.

It will be appreciated that, in the absence of the extension tabs 27, the cup-like article-receiving structures could sag somewhat under the weight of the batteries B placed therein, thus forming a somewhat irregularly shaped package 50. However, the presence of the extension tabs 27 secured to the header panels 32 ensures that the package 50 will be able to withstand the weight of the batteries B placed therein without deforming or sagging.

Referring now to FIGS. 2–4 in particular, the erected and filled package 50 of the present invention is both ecologically-acceptable and easy-to-open. It is formed exclusively of paperboard for the display and sale of a plurality of cylindrical articles as a unit and, as indicated in FIG. 4, it may be suspended by a support S extending through the header aperture 36 or rested on its bottom 64.

The package comprises a base, generally designated 60, for maintaining a plurality of cylindrical articles (such as the batteries B) upright and parallel in a compact, non-linear, horizontally aligned configuration. The base 60 includes a base top generally designated 62 (formed by the two top half-panels 14 and the four top dust flaps 26), a base bottom generally designated 64 (formed by the bottom panel 12 and the four bottom dust flaps 24) and a base sidewall 66 which connects the base top 62 and the base bottom 64 (formed by the two side half-panels 16 and the two side seal flaps 28 joining them). Extending upwardly from the base top 62 is an optionally apertured header, generally designated 70 and formed by the two header panels 32 and the four extension tabs 27.

The illustrated embodiment has a base 60 which is configured and dimensioned to maintain four of the cylindrical articles (i.e., the batteries B) upright and parallel. The base sidewall is generally hexagonal to permit a compact non-linear orientation of the cylindrical articles B. The base top 62 defines a central aperture 34 through which all of the cylindrical articles B may be viewed, and the base sidewall 66 defines additional apertures 30 through which each cylindrical article B may be viewed.

It will be appreciated that, in the absence of tearing of the base 60, the cylindrical articles B within the base 60 are not removable therefrom without substantial separation of the two header panels 32 of the header 70 and thus are not removable therefrom while the header 70 is suspended by the aperture 36 from a support S as illustrated in FIG. 4.

The top and bottom dust flaps 26, 24 reenforce the base top and bottom 62, 64, respectively. Thus, where the package is intended for the support of lighter cylindrical articles than the proposed batteries B (or for the support of smaller batteries, such as "AAA" batteries, than "D" batteries), it is possible to dispense with the extension tabs 27 and rely simply on the reenforcement provided by the adherence of the top and bottom dust flaps 26, 24 to the base top and bottom 62, 64, respectively.

While the present invention is illustrated in FIGS. 1–6 as having a generally angular configuration (with the header being rectangular, the sidewalls being rectangular, the dust flaps being triangular, and the base panel being hexagonal), it will be appreciated that a less angular, more curved embodiment may be made where desired. Thus the base top 62, base sidewall 66, and base bottom 64 may be more oval in plan, and the header 70 itself may be oval in elevation without detracting from the principles of the present invention.

The blank 10 may be formed of any of a variety of different paperboard materials depending upon the intended application of the erected package 50, more demanding applications requiring stronger paperboard materials.

Because the package 50 is made exclusively of paperboard and the consumer can therefore easily tear the paperboard of the base means 60 (for example, between the apertures 30) or simply tear off the header 70 and base top 62 from the base means 60 (so that the interior of the base means 60 becomes more-or-less accessible), the consumer finds the package much easier to open than a conventional plastic blisterboard package. From the point of view of the manufacturer, not only is the package economical to manufacture and of sufficient strength that it can be relied upon for the packaging of even dense cylindrical articles, but the preferred process for forming the package from the blank lends itself to a swift and efficient operation which includes the deposition of the cylindrical articles within the package. Once the header panels 32 have been glued together to form header 70 and the side extension flaps 28 have been appropriately glued to the opposite side half-panels 16 to form the base sidewall 66, the cylindrical articles are compactly and securely maintained within the erected package 50.

Whereas the first embodiment 10 and 50 of the blank and package, respectively, defines a relatively wide base means for maintaining a plurality of the cylindrical articles upright and parallel in a compact, non-linear, horizontally- aligned configuration particularly (although not exclusively) suitable for containing at least four of the cylindrical articles on both sides of the header, a second embodiment 10' and 50' of the blank and package, respectively, defines a relatively thin base means for maintaining a plurality of the cylindrical articles upright and parallel in a compact, linear, horizontally-aligned configuration particularly (although not exclusively) suitable for containing at least two of the cylindrical articles on one side of the header. Except as expressly noted below, the blank 10' and the package 50' of the second embodiment are similar to the blank 10 and package 50 of the first embodiment, and similar elements in the second embodiment are identified by the same numeral primed.

Figure 6:
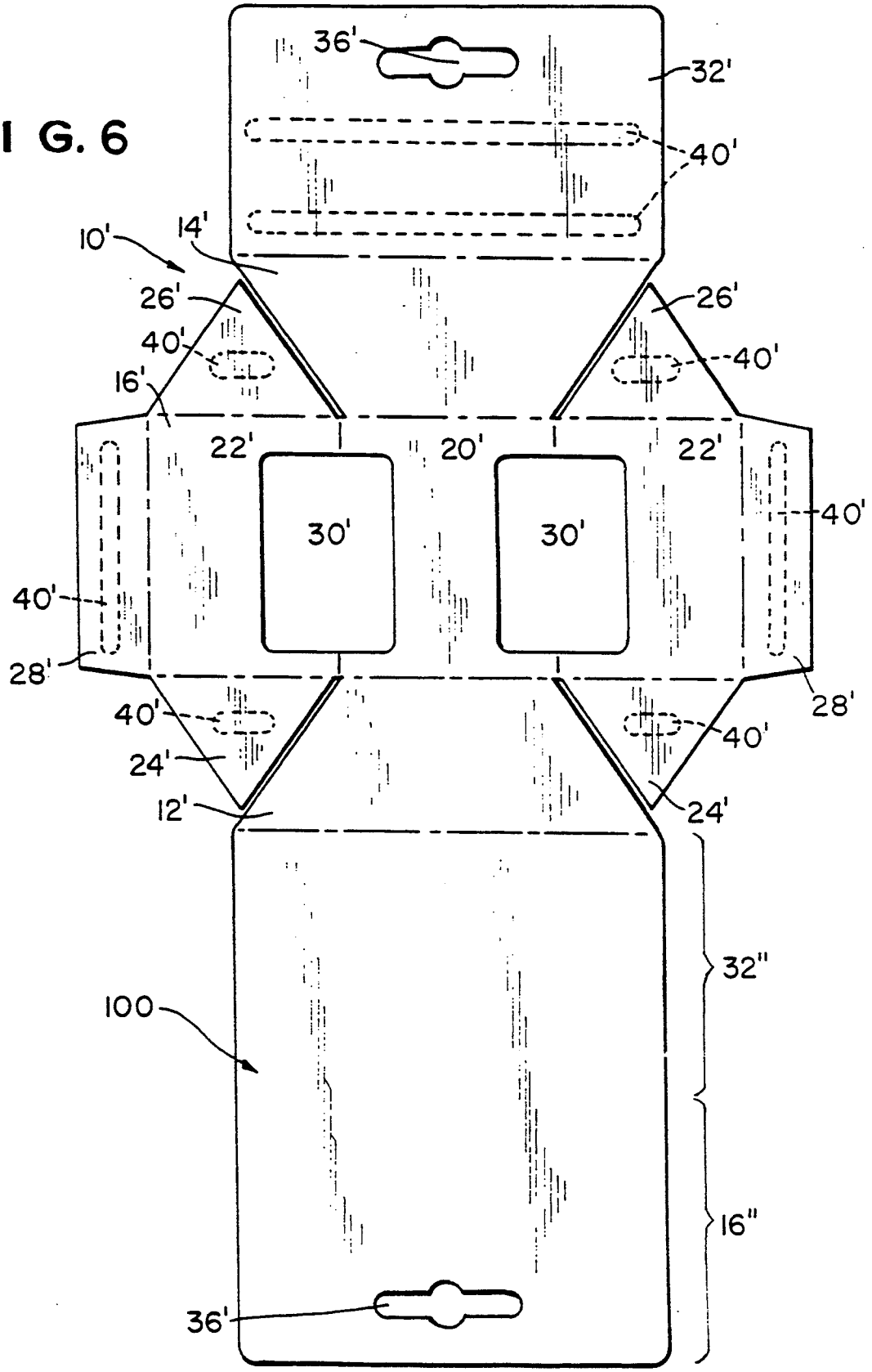
FIG. 6 is a top plan view of a blank according to a second embodiment of the present invention.

Referring now to FIG. 6, the blank 10' is similar to one-half of the blank 10 except that there are only two apertures 30' rather than three, there are no extension tabs 27 on the upper dust flaps 26', and both side seal flaps 28' are necessarily disposed on the side half-panel 16'. Thus, the blank 10' includes a generally trapezoidal bottom panel 12', a generally trapezoidal top half-panel 14', and a generally rectangular side half-panel 16' having side seal flaps 28' at the ends thereof and defining a pair of apertures 30'. (It will be appreciated that the top half-panel 14' is in the second embodiment the only top panel.) The side half-panel 16' also defines, extending from each end portion 22' of the side half-panel 16', a pair of bottom dust flaps 24' to be glued to the bottom panel 12' and a pair of upper dust flaps 26' to be glued to the top half-panel 14'. A header panel 32' is connected to the top half-panel 14' by a foldline.

The other half of the blank 10' is comprised of a generally rectangular panel generally designated 100. The panel 100 may be conceptually thought of as consisting of a planar sidewall portion 16'' secured to the bottom panel 12' by a foldline and a header portion 32'' extending outwardly therefrom, although there is no physical line of demarcation between the two portions 16'' and 32'' in either the blank 10' or the erected package 50'.

As illustrated, there is no oval aperture 34 intermediate the top half-panel 14 and header panel 32', although an oval aperture (not shown) may be disposed within a top half-panel 14' if desired. As in the first embodiment, the header panel 32' and header portion 32'' define an aperture 36' therethrough. Because the package 50' of the second embodiment requires only the strength to bear the weight of, for example, two "D" batteries, the extension tabs 27 of the first embodiment 50 are not required. However, if found desirable, extension tabs (not shown) may be disposed on the free side of the top dust flaps 26' and be glued to and intermediate the header panel 32' and the header portion 32''. Glue areas 40' are appropriately disposed on the blank 10 or applied to the indicated areas of the blank 10' as it is being erected to form the package 50'.

Figure 10:
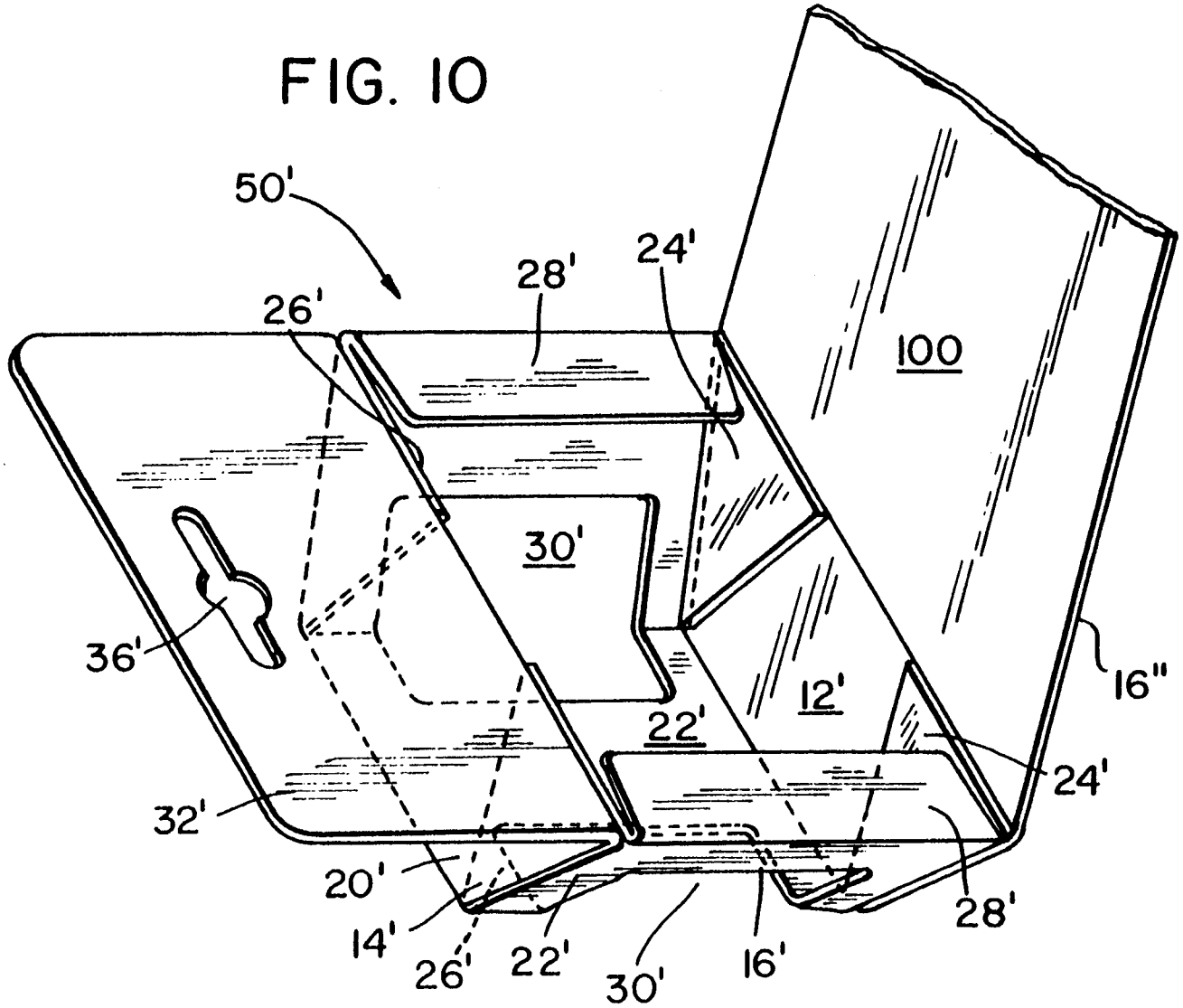
FIG. 10 is a fragmentary isometric view of the package in an intermediate stage of erection.

Referring now to FIG. 10, the half of the erected package 50' having the sidewall 16' is erected and filled essentially in the same manner as each half of the rigid package 50 of the first embodiment (preferably using a mandrel) except that there are no extension tabs 27 to be glued to the header panel 32'. Once this half of the package 50 is erected, it is filled with two "D" batteries. Then panel 100 is folded over the erected and filled half of the package 50' and glued to the side seal flaps 28' and header panel 32' to close and seal the half-package. If sagging of the cup-like article-receiving structure occurs, extension tabs similar to extension tabs 27 may be employed to further strengthen the package 50'.

Figure 9:
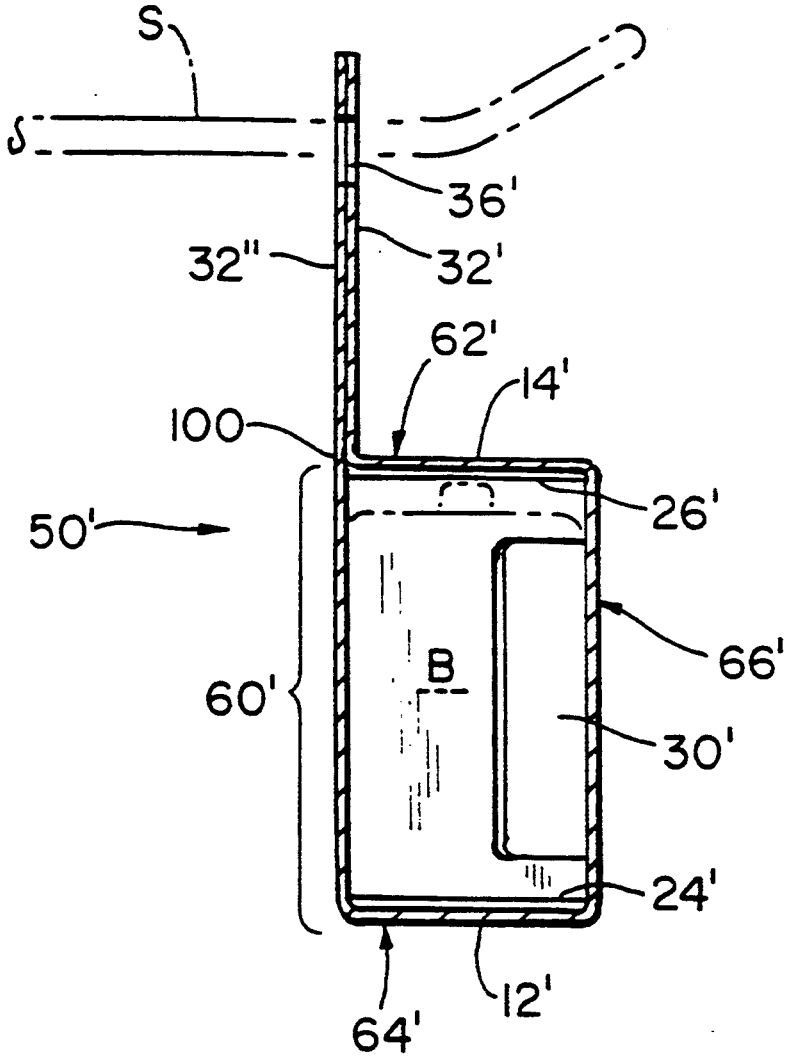

Referring now to FIGS. 7–9 in particular, the erected and filled package 50' comprises a base, generally designated 60', for maintaining a plurality of cylindrical articles such as "D" batteries upright and parallel in a compact, linear, horizontally-aligned configuration. The base 60' includes a base top generally designated 62', a base bottom generally designated 64', and a base sidewall generally designated 66' which connects the base top 62' and the base bottom 64'. Extending upwardly from the base top 62' is an optionally apertured header generally designated 70 formed by the header panel 32' and the header portion 32''. The illustrated embodiment 50' has a thin base 60' configured and dimensioned to maintain at least two of the cylindrical articles upright and parallel, the base sidewall 66' being generally trapezoidal in plan to provide a compact linear orientation of the cylindrical articles B therein on one side of panel 100.

Package 50'of the second embodiment is both easily and economically erected and filled, as illustrated in FIG. 10. It is formed exclusively of paperboard for the display and sale of a plurality of cylindrical articles as a unit, and, as indicated in FIG. 9, may be suspended by a support S extending through the header aperture 36' or rested on its bottom.

Figure 11:
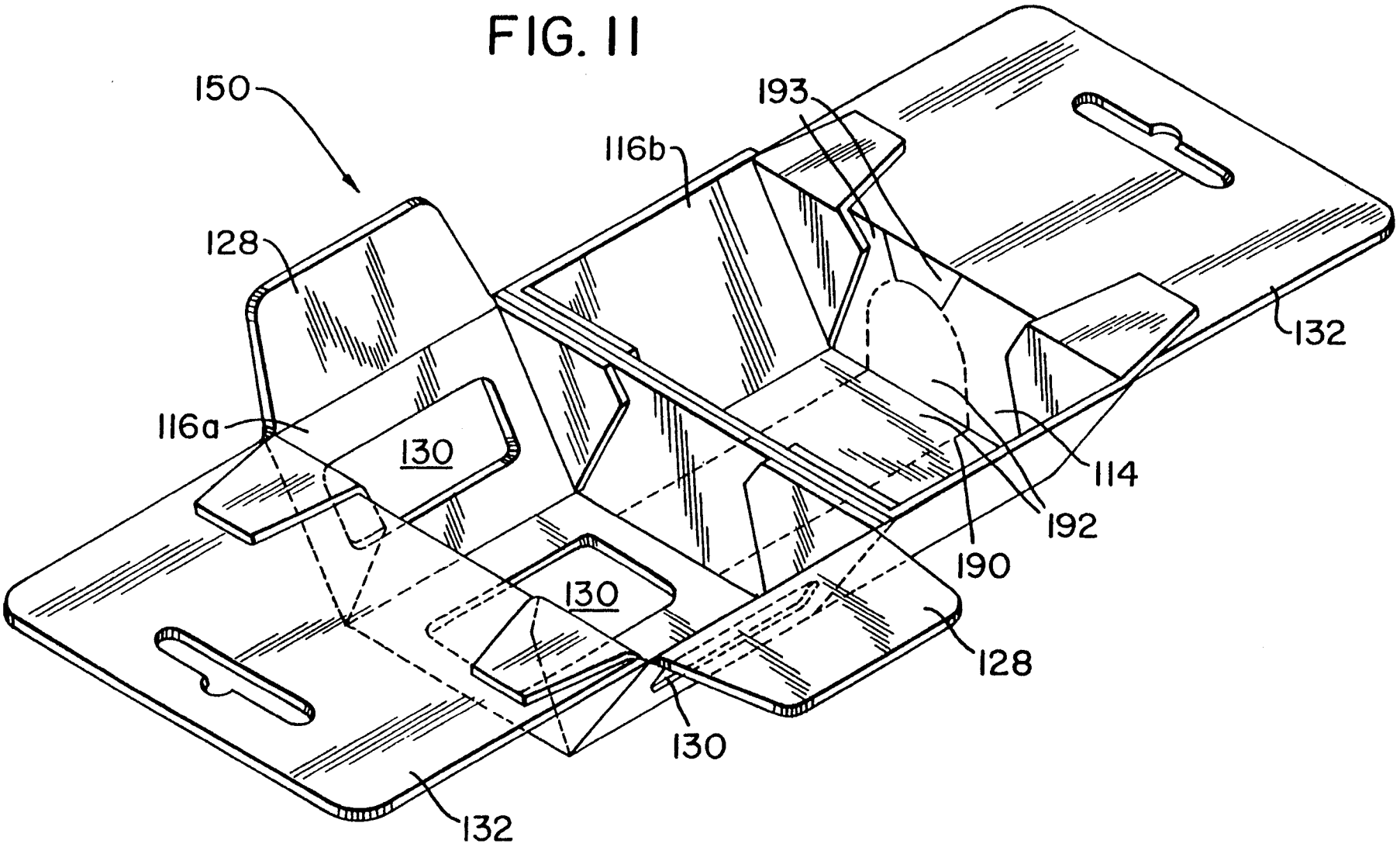
FIG. 11 is an isometric view of a partially erected package of a variation of the first embodiment.
Figure 12:
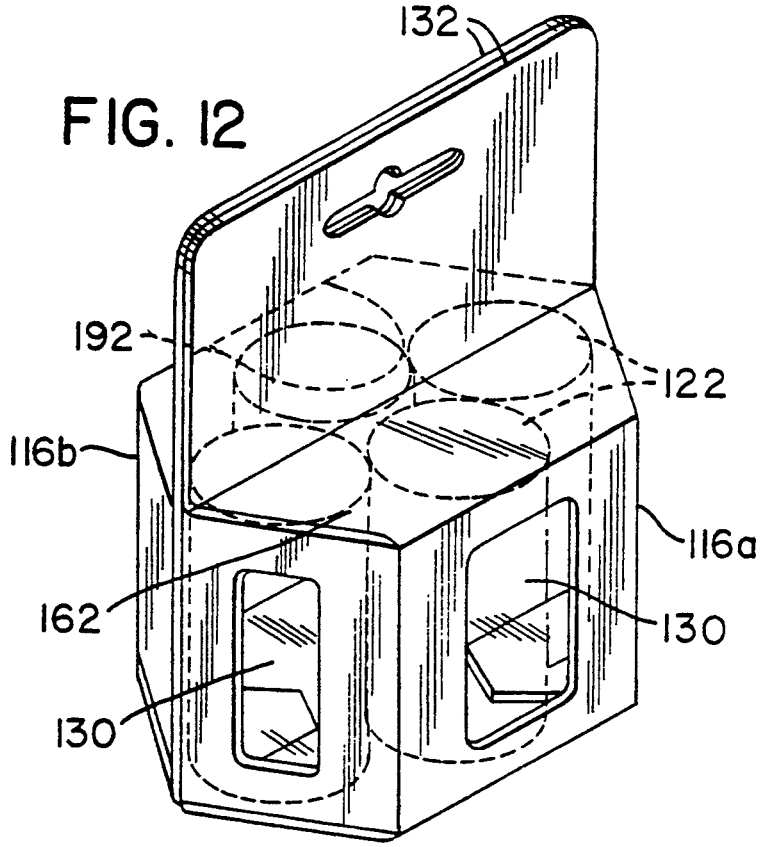
FIGS. 12 and 13 are isometric views from the front and rear, respectively, of the erected package variation.
Figure 13:
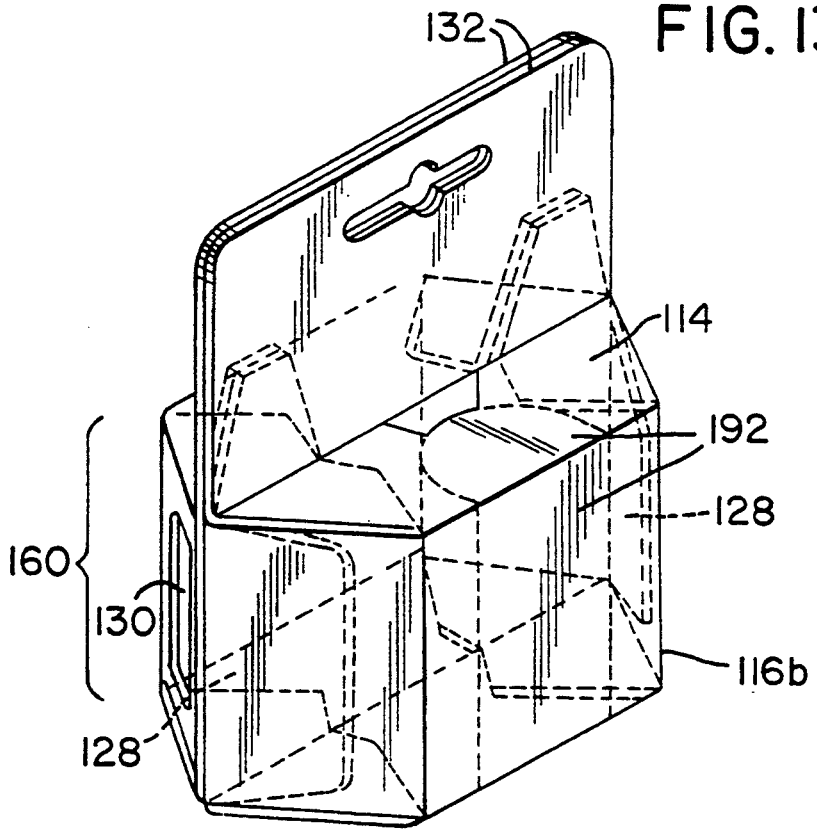

Referring now to FIGS. 11–13, therein illustrated is a variation 150 of the package 50 according to the first embodiment, the variation enabling easy opening of the package without any tearing of the package (i.e., any unweakened paperboard). Elements of the variation 150 which are structurally and/or functionally similar elements of package 50 of the first embodiment are identified by same reference numeral in the 100 series.

The variation package 150 is substantially similar to the first embodiment package 50. One of the side half-panels **116*a* defines a plurality of side panel apertures 130 therethrough (just as one of the side half-panels 16*a* of the first embodiment defines a plurality of apertures 30 therethrough) for viewing therethrough of each of the cylindrical articles 22 adjacent the one side half-panel. However, unlike the first embodiment 50, in the variation 150 the other side half-panel 116*b* is unapertured. Instead, the unapertured side half-panel 116*b*, in cooperation with the base top 162 (and in particular the top half-panel 114 adjacent thereto) has a line of weakness 190 defining an openable door 192. The adjacent top half-panel 114 defines cuts 193 which enable the user to insert his finger behind the door 192 so that it may be displaced outwardly along the line of weakness 190, thereby to enable successive passage therethrough of the cylindrical articles 122 without any tearing of the package 150 (and in particular the base 160). The line of weakness 190 is typically a perforated or semi-perforated line extending up both lateral sides of the door 192 and across the top end thereof (illustrated as curved). If desired, each end portion of the side half-panel 116*b* may also define an aperture 130**.

In the variation 150, there is no oval aperture defined by the top half-panels 114 and adjacent header panels 132 (like oval aperture 34 of the first embodiment 50). Additionally since there are no apertures in the central portion of side half-panel **116*b* defining a portion of door 192, the foldable side seal flaps 128 extending from the other side-half panel 116*a* may be appreciably larger so as to overlap further with the end portions of the side half-panel 116*b*, thereby to provide an even more secure package 150**.

To summarize, the present invention provides a package for the display and sale of a plurality of cylindrical articles as a unit, the package being both ecologically-acceptable and easy-to-open. The package enables the prospective purchaser to confirm that the intended number of articles are present in the package and in good condition. In a relatively wide package intended to hold at least four articles, the articles extend to both sides of the header, while in a relatively narrow package intended to hold at least two articles in a linear orientation, the articles extend only to one side of the header. Finally, the present invention provides blanks from which such packages can be formed.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. An ecologically-acceptable and easy-to-open package formed exclusively of paperboard for the display and sale of a plurality of cylindrical articles as a unit, said package comprising:

(A) base means for maintaining a plurality of cylindrical articles upright and parallel in a compact, non-linear, horizontally-aligned configuration, said base means including a base top, a base bottom, and a base sidewall connecting said base top and said base bottom and being defined by a pair of base half-sidewalls disposed in an opposed relationship and a pair of side seal flaps, each side seal flap extending from a given base half-sidewall and being secured to another base half-sidewall; and (B) header means for extending upwardly from said base top;

said base means additionally including extension means for overlapping, being disposed in and being adhered to said header means.

2. The package of claim 1 wherein said base means is configured and dimensioned to maintain four of the cylindrical articles upright and parallel.

3. The package of claim 2 wherein said base sidewall is generally hexagonal.

4. The package of claim 1 wherein said base top defines a central aperture therethrough through which each of the cylindrical articles may be viewed.

5. The package of claim 1 characterized in that it is formed from a single paperboard blank.

6. The package of claim 1 wherein said header means is formed of two upwardly extending header panels glued together.

7. The package of claim 6 wherein, in the absence of tearing of said base means, the cylindrical articles within said base means are not removable therefrom without separation of said two header panels of said header means.

8. The package of claim 1 wherein the cylindrical articles within said base means are not removable therefrom while said header means is suspended by said aperture from a support.

9. The package of claim 1 wherein a center portion of each base half-sidewall extends from said base bottom at the bottom and from said base top at the top.

10. The package of claim 9 wherein the side portions of each base half-sidewall are non-parallel to said center portion thereof.

11. The package of claim 10 wherein the side portions of each base half-sidewall define top and bottom dust flaps overlapping, adhered to and reinforcing said base top and said base bottom, respectively.

12. The package of claim 11 wherein said top dust flaps define said extension means as tabs overlapping, disposed in and adhered to said header means.

13. The package of claim 1 wherein said header means defines an aperture for hanging of said package from a support.

14. The package of claim 1 wherein said base sidewall enables viewing of each of the cylindrical articles.

15. The package of claim 1 wherein said base sidewall defines a plurality of apertures therethrough for viewing of each of the cylindrical articles.

16. An ecologically-acceptable and easy-to-open package formed exclusively from a single paperboard blank for the display and sale of a plurality of cylindrical articles as a unit, said package comprising:

(A) generally hexagonal base means for maintaining four cylindrical articles upright and parallel in a compact, non-linear, horizontally-aligned configuration, said base means including a base top, a base bottom, and a base sidewall connecting said base top and said base bottom and defining a plurality of apertures therethrough for viewing of at least some of the cylindrical articles, said base sidewall being defined by a pair of base half-sidewalls disposed in an opposed relationship and a pair of non-engaging side seal flaps, each side seal flap extending from a given base half-sidewall and being secured to another base half-sidewall, a center portion of each base half-sidewall extending from said base bottom at the bottom and from said base top at the top, the side portions of each base half-sidewall being non-parallel to said center portion and defining top and bottom dust flaps overlapping, adhered to and reinforcing said base top and said base bottom, respectively; and (B) header means for extending upwardly from said base top and formed of two upwardly extending header panels glued together;

said top dust flaps additionally including extension tabs overlapping, disposed in and adhered to said header means;

wherein, in the absence of tearing of said base means, the cylindrical articles within said base means are not removable therefrom without separation of said two header panels of said header means, and, while said header means is suspended by said aperture from a support, the cylindrical articles within said base means are not removable therefrom.

17. The package of claim 16 wherein said base sidewall is defined by a pair of base half-sidewalls disposed in an opposed relationship and a pair of non-engaging side seal flaps, each side seal flap extending from a given base half-sidewall and being secured to another base half-sidewall, a center portion of each base half-sidewall extending from said base bottom at the bottom and from said base top at the top, the side portions of each base half-sidewall being non-parallel to said center portion and defining top and bottom dust flaps overlapping, adhered to and reinforcing said base top and said base bottom, respectively; said top dust flaps further defining said extension means as tabs overlapping, disposed in and adhered to said header means.

18. A unitary, integral, one-piece paperboard blank for an all-paperboard display and sale package, comprising:

(A) a bottom panel;

(B) a pair of top half-panels cooperatively defining a top panel in the erected package;

(C) a pair of side half-panels cooperatively defining a side panel in the erected package, the center portion of each side half-panel joining a respective opposed side of a center portion of said bottom panel and a center portion of a respective top half-panel, the end portions of each side half-panel defining at the bottom thereof bottom dust flaps configured and dimensioned to overlap said bottom panel in the erected package and at the top thereof top dust flaps configured and dimensioned to overlap said top panel in the erected package; and (D) a header defined by a pair of header panels extending from respective top half-panels, said header panels being secured together in the erected package to form a header, said header in the erected package causing said pair of top half-panels to cooperatively define said top panel and said pair of side half-panels to cooperatively define said side panel;

said top dust flaps further defining extension tabs configured and dimensioned to overlap, be disposed in and adhered to said header in the erected package.

19. The blank of claim 18 wherein in the erected package said bottom dust flaps overlap side portions of said bottom panel and said top dust flaps overlap side portions of said top half-panels.

20. The blank of claim 18 wherein said side half-panels together define a pair of side seal flaps adapted to extend from a given side half-panel and be secured to another side half-panel in the erected package.

21. The blank of claim 18 wherein said top half-panels are generally trapezoidal, said side half-panels are generally rectangular, and said bottom panel is generally hexagonal; and in the erected package, said top, side and bottom panels are each generally hexagonal in plan.

22. The blank of claim 21 wherein said bottom panel defines a straight foldline extending from one side thereof to the other.

23. The blank of claim 18 wherein said side half-panels define a plurality of apertures which in the erected package enable viewing of the contents thereof.

24. A unitary, integral, one-piece paperboard blank for an all-paperboard display and sale package, comprising:

(A) a bottom panel;

(B) a pair of top half-panels cooperatively defining a top panel in the erected package;

(C) a pair of side half-panels cooperatively defining a side panel in the erected package, the center portion of each side half-panel joining a respective opposed side of a center portion of said bottom panel and a center portion of a respective top half-panel, the end portions of each side half-panel defining at the bottom thereof auxiliary bottom dust flaps configured and dimensioned to overlap, be adhered to and reinforce side portions of said bottom panel in the erected package and at the top thereof top dust flaps configured and dimensioned to overlap, be adhered to and reinforce side portions of said top panel in the erected package, said side half-panels together defining a pair of side seal flaps adapted to extend from a given side half-panel and be secured to another side half-panel in the erected package; and (D) a pair of header panels extending from respective top half-panels and secured together in the erected package to define a header, said header in the erected package causing said pair of top half-panels to cooperatively define said top panel and said pair of side half-panels to cooperatively define said side panel;

said top dust flaps further defining extension tabs configured and dimensioned to overlap, be disposed in and adhered to said header in the erected package;

said top half-panels being generally trapezoidal, said side half-panels being generally rectangular, and said bottom panel being generally hexagonal; and in the erected package, said top, side and bottom panels being each generally hexagonal in plan.

25. The package of claim 1 wherein one of said base half-sidewalls defines a plurality of apertures therethrough for viewing of each of the cylindrical articles adjacent said one base half-sidewall, and the other of said base half-sidewalls is unapertured.

26. The package of claim 1 wherein one of said base half-sidewalls in cooperation with said base top has a line of weakness defining an openable door, which door, when open, enables successive passage therethrough of the cylindrical articles without any tearing of said package.

* * * * *